United States Patent [19]

Frantum, Jr. et al.

[11] Patent Number: 4,795,364

[45] Date of Patent: Jan. 3, 1989

[54] INSULATION DISPLACING BARREL TERMINAL

[75] Inventors: Albert W. Frantum, Jr., Elizabethtown; Jack W. Lawhead, Harrisburg; Winfield W. Loose, Lingelstown, all of Pa.

[73] Assignee: AMP Incorporated, Harrisburg, Pa.

[21] Appl. No.: 52,517

[22] Filed: May 20, 1987

[51] Int. Cl.[4] ..... H01R 4/24

[52] U.S. Cl. ..... 439/407; 439/409

[58] Field of Search ..... 439/391, 392, 395, 398, 439/399, 400, 401, 403, 407, 409, 410, 431, 432, 449, 460, 445, 447, 604, 417, 389

[56] References Cited

U.S. PATENT DOCUMENTS

| | | | |
|---|---|---|---|
| 3,975,812 | 8/1976 | Fleischacker et al. | 29/203 MW |
| 4,431,247 | 2/1984 | Abdullah et al. | 339/97 P |
| 4,637,675 | 1/1987 | Loose | 339/97 R |
| 4,705,340 | 11/1987 | Loose | 439/395 |

FOREIGN PATENT DOCUMENTS

| | | | |
|---|---|---|---|
| 0005350 | 11/1979 | European Pat. Off. | 439/395 |
| 2042284 | 9/1980 | United Kingdom | 439/395 |

*Primary Examiner*—David Pirlot
*Attorney, Agent, or Firm*—Eric J. Groen

[57] ABSTRACT

An electrical terminal includes a barrel terminal having an L-shaped slot which includes a vertical portion which extends to the upper edge of the terminal, the vertical portion being in transition with a horizontal portion extending partially around the terminal. A cap which is profiled for receipt over the terminal includes an opening which is disposed diagonally through the cap relative the length of the cap. The cap also includes a window which exposes the opening from the end face of the cap for viewing the location of the opening and for viewing the insertion of the wire into the opening. Upon insertion of the wire into the cap, placing the wire in the opening and placing a tool over the cap which pushes the wire into the vertical slot, rotation of the cap and tool moves the wire into the horizontal portion of the L-shaped slot and terminates the end of the wire in a wire receiving slot. Strain relief members are disposed above the opening in the face of the cap and comprises downwardly directed fingers which capture the wire upon termination of the wire.

16 Claims, 9 Drawing Sheets

INSULATION DISPLACING BARREL TERMINAL

BACKGROUND OF THE INVENTION

1. Field of the Invention

The invention relates to an insulation displacement terminal utilizing a wire receiving opening in line with a longitudinal wire slot wherein placing a wire in the wire receiving opening and rotating the wire relative to the terminal, terminates the wire in the wire receiving slot.

2. Description of the Prior Art

There are many instances where terminal blocks are set up in high density arrays. Many of these terminal blocks are simply threaded members fixed with insulation material which receive wires either wrapped around the threaded members and secured thereto by an application of a nut or the wires are terminated by known spade or ring terminals and then secured to the threaded member by a nut. While these have, in some instances, provided effective means for termination, they have not always been convenient for maintenance or repair and they frequently are subjected to environmental degradation with a resulting loss of desired electrical characteristics.

U.S. Pat. Nos. 4,431,247 and 4,637,675 show terminals which can be utilized in such an array although the entry for the wire is orthogonal to the terminal length. As the arrays of terminals become denser the centerline spacing between terminals become smaller, leaving less room to manipulate wires into the side of a barrel terminal. This problem is magnified when the array is mounted in a vertical plane with the terminals located in a horizontal plane as the wire opening is difficult to see.

SUMMARY OF THE INVENTION

It is the object of the instant invention to design a terminal having a rotatable cap such that upon inserting a wire through a wire receiving opening and rotating the cap, the insulated wire becomes terminated within a wire receiving slot which is in transition with the wire receiving opening.

It is a further object of the instant invention to be able to mount a plurality of the terminals through an insulative housing which is mounted in a vertical plane.

It is a further object of the instant invention to provide the wire receiving opening proximate to the end face of the rotatable cap such that the wire receiving opening can be easily seen when the termination of the wire is desired.

It is a further object of the invention to provide a strain relief means on the cap which retains the insulated wire after the termination of the insulated wire into the terminal.

The above mentioned objects were accomplished by designing a terminal which includes a cylindrical terminal having a wire receiving slot and a rotatable cap over the terminal with an opening in the cap aligned with the opening in the terminal, such that placing the wire through the cap and into the wire receiving opening in the terminal and rotating the cap terminates the wire in the wire receiving slot. The cap includes a diagonal opening which is partially in the front face and partially in the end face, whereby providing a wire receiving opening which is accessible and viewable from the end face. The terminal includes an L-shaped slot such that the wire can be placed into the terminal for termination and retention. With the insulated wire rotated into the horizontal portion of the L-shaped slot, it is impossible to lift the wire out of the cap.

The connector also includes a strain relief member which is integrally molded as a unitary portion of the cap and includes resilient strain relief fingers which extend above the opening in the front face of the cap and extend downwardly to overlie the opening.

BRIEF DESCRIPTION OF THE DRAWINGS

FIG. 3 is an isometric view of the rotatable cap.

FIG. 3A is a cross-sectional view through lines 3a—3a of FIG. 3.

FIG. 8 shows a view similar to that of FIG. 7 showing a tool for terminating the insulated conductor.

DETAILED DESCRIPTION OF THE PREFERRED EMBODIMENT

Figure 1:
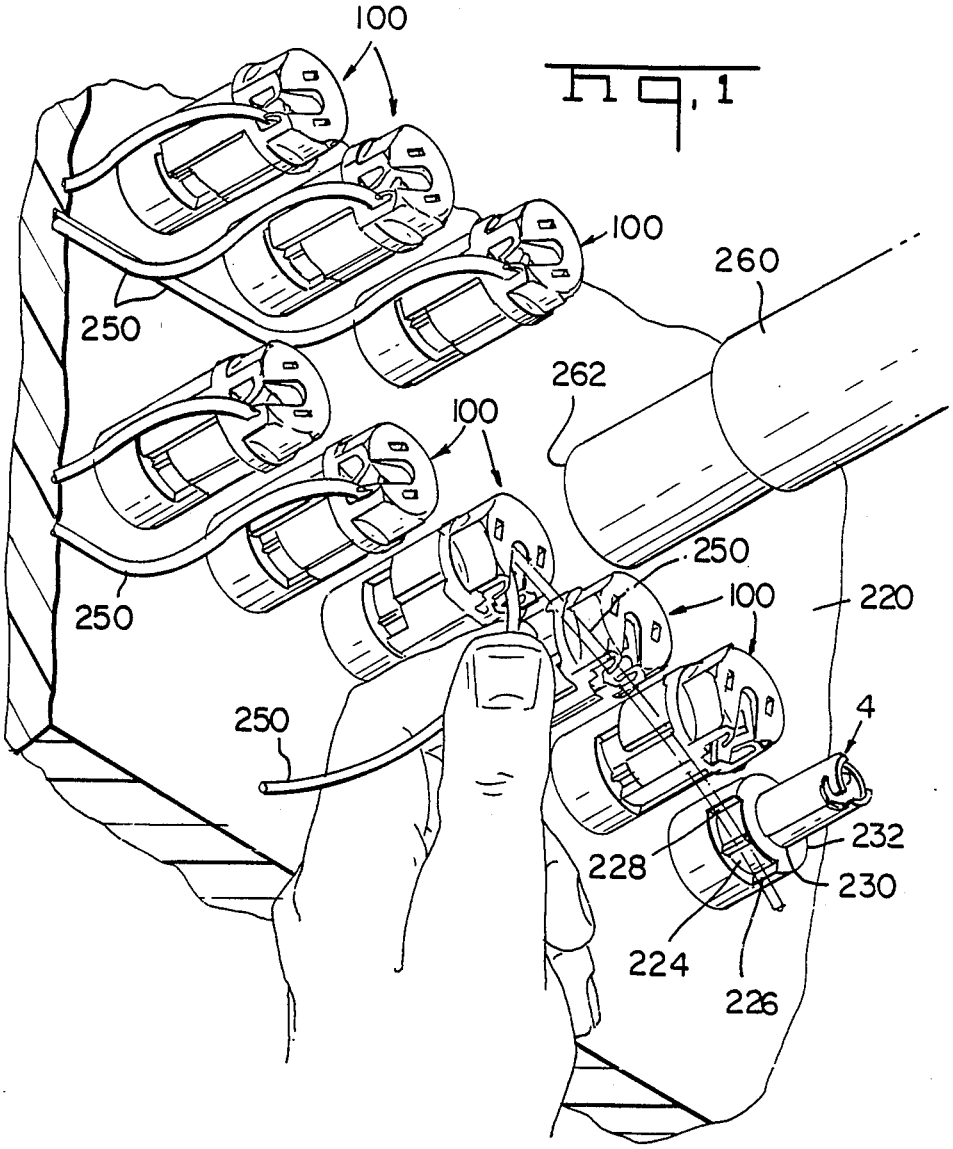
FIG. 1 is an isometric view of a high density array of terminals and rotatable caps mounted within an insulative housing and mounted in a vertical plane.

Referring to FIG. 1, the instant invention includes a spiral wrapped terminal 4 and an insulative cap 100 mounted to the terminal, the terminal and cap being mountable within an opening 230 in the insulative housing 220. The insulative housing 220 includes a plurality of pedestals 232 having detents including stop surfaces 226 and 228 with a recessed area 224 therebetween. A detent cam 225 is located midway between the detent stop surfaces 226 and 228 to both indicate positive positioning and prevent accidental opening of the cap after termination.

Figure 2A:
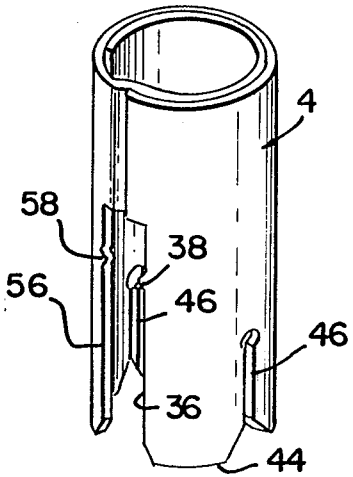
FIG. 2A is a partial isometric view of the lower portion of the spiral wrapped terminal.
Figure 7A:
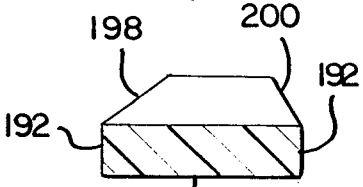
FIG. 7 is a view similar to that of FIG. 6 showing the acceptance of an insulated conductor.
Figure 2:
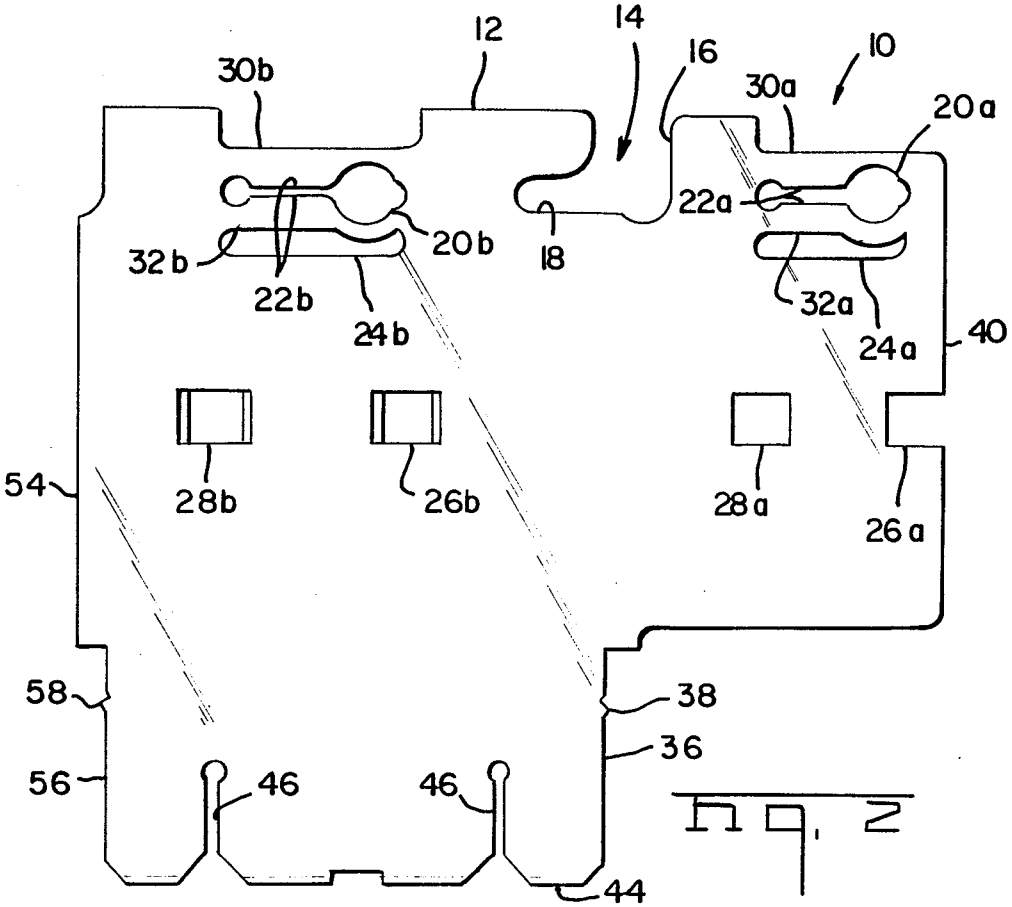
FIG. 2 is a front plan view of the stamped blank prior to spiral wrapping the terminal.

With reference to FIG. 2, the terminal will be described in greater detail. It should be noted in FIG. 2 that the stamped blank 10 includes an inner and outer layer which will later be formed into a spirally wrapped terminal. When components are referred to in the flat blank stage, the component will be referred to as a numeral including a postscript letter; when the component is referred to in the formed stage, the components will be referred to generally as a numeral disregarding the postscript.

The flat blank 10 generally includes an upper edge 12, a leading edge 40, a lower edge 44 and a trailing edge 54. An L-shaped slot 14 is in communication with the upper edge 12 of the blank 10 and generally includes a vertical slotted portion 16 which is in transition with a horizontal slotted portion 18. The stamped blank also includes an inner wire receiving opening **20*a* which is in transition with an inner wire receiving slot 22*a*. The flat blank 10** also includes an outer wire receiving opening 20*b* which is in transition with an outer wire receiving slot 22*b*. An inner strain relief slot 24*a* is disposed below the inner wire receiving slot 22*a* and an outer strain relief slot 24*b* is disposed below the outer wire receiving slot 22*b*.

It should also be noted that the upper edge 12 of the stamped blank 10 has a first stepped down portion 30*a* above the inner wire receiving slot 22*a* and a second stepped down portion 30*b* which is disposed above the outer wire receiving slot 22*b*. The edges 30*a* and 32*a* are equidistant from respective slot edges 22*a*, and edges 30*b* and 32*b* are equidistant from respective slot edges 22*b*. This allows each of the respective edges 22*a* and 22*b* to equally deflect during the termination of the conductor. The stamped blank further includes inner 26*a* and outer 26*b* detent openings and second inner 28*a* and outer 28*b* detent openings. Two lower wire receiving slots 46 are located upwardly from the lower edge 44 which form a lower wire receiving insulation displacement portion. The stamped blank 10 further includes edges 36 and 56 having respective barbs 38 and 58.

Figure 4:
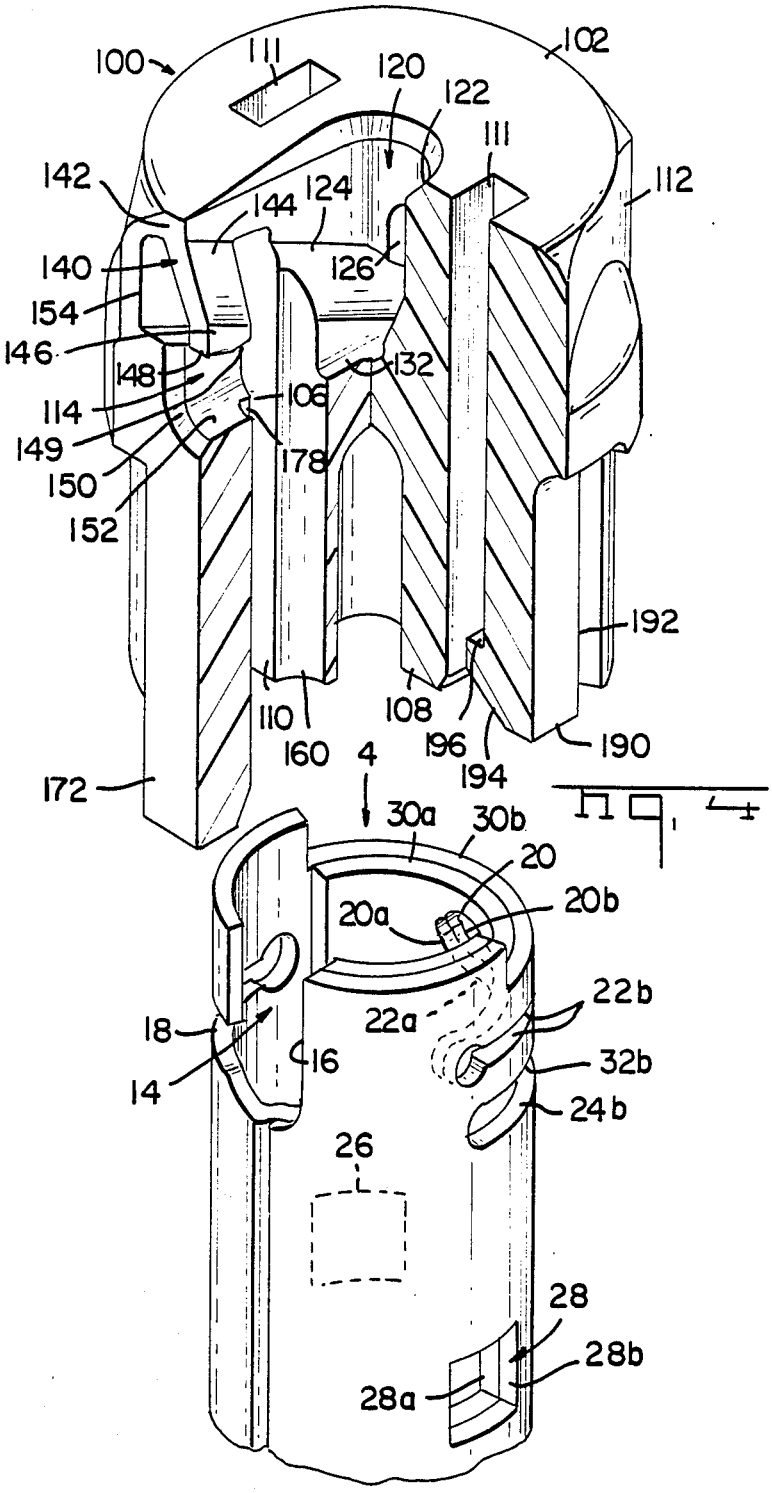
FIG. 4 is an isometric view of the insulative cap showing a half cutaway through the wire receiving opening and showing the cap exploded above the terminal.

Referring now to FIG. 4, the stamped blank 10 is shown in a formed configuration whereby outer wire receiving opening 20*b* overlaps inner wire receiving opening 20*a* and likewise the outer wire receiving slot 22*b* overlaps the inner wire receiving slot 22*a*. This spiral wrapping also positions outer detent opening 26*b* over the inner detent opening 26*a* and outer detent opening 28*b* over inner detent opening 28*a*. The forming of the terminal also positions edge 36 adjacent to but spaced from edge 56 which forms a slot between the two edges 36 and 56, as shown in FIG. 2A.

Figure 5:
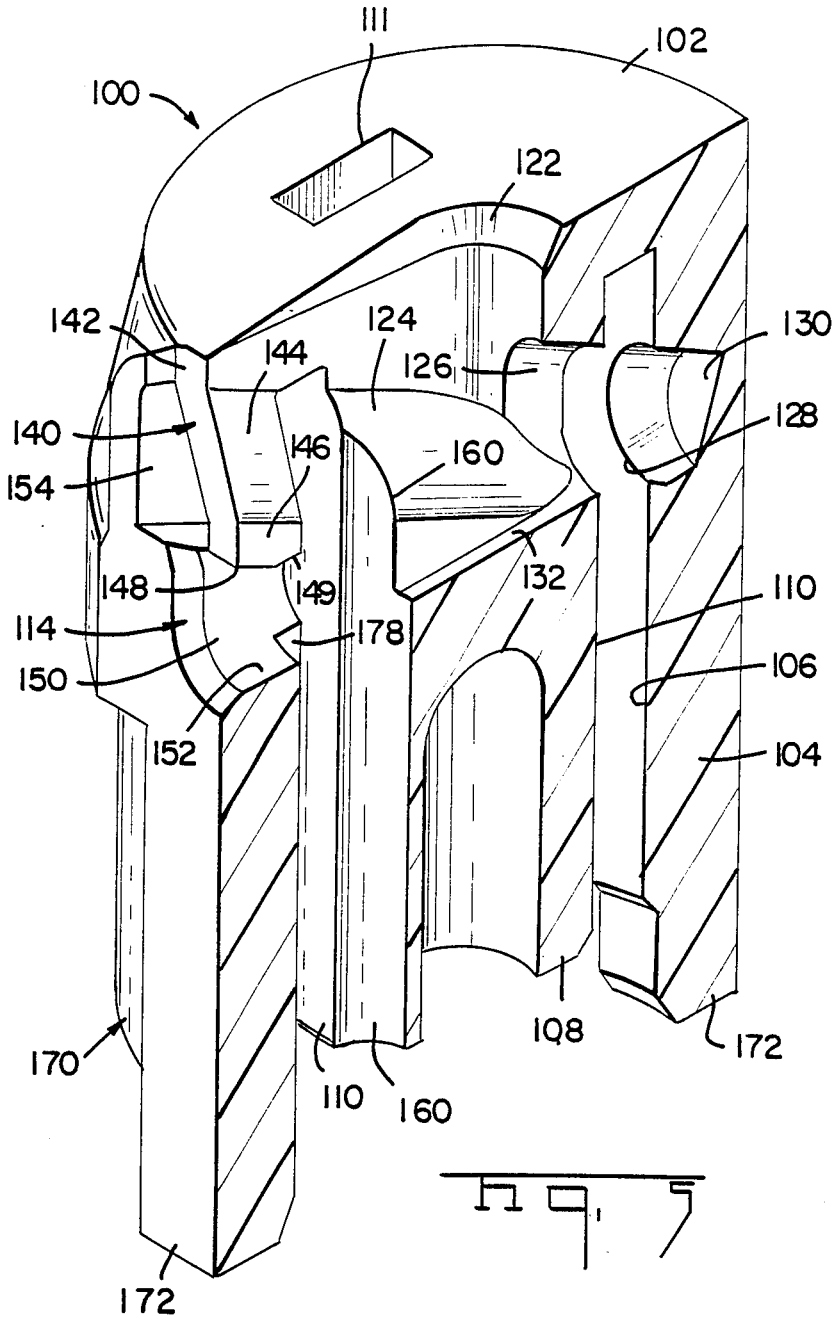
FIG. 5 is a full cutaway through the isometric view of FIG. 3 showing the wire receiving opening.

With reference now to FIGS. 3–5, the rotatable cap 100 will be described in greater detail. With reference first to FIG. 3, the rotatable cap 100 generally includes a central insulative body 170 having an upper hexagonal portion formed by the hexagonal flats 112. The insulative cap 100 further includes a wire positioning window 120 which extends below an upper face 102 of the cap and is generally defined by a U-shaped peripheral surface 122. The cap also includes a wire receiving opening 114 projecting inwardly from the front wire receiving face 116.

With reference now to FIG. 5, the cap 100 is shown as including an inner cylindrical portion 108 having an outer surface 110 and further includes an outer cylindrical portion 104 having an inner surface 106, the cylindrical surfaces 106 and 110 cooperatively providing a cylindrical recess for receiving the terminal therebetween. The wire receiving opening 114 within the cap includes a raised protuberance 124 which is sloping downwardly as it progresses towards the center of the cap. Semicircular channel 160 extends from the protuberance 124 downwardly through the cap. The raised protuberance 124 is in communication with an opening 126 which extends through the inner wall 108 and through the cylindrical opening which is defined by surfaces 106 and 110. The opening 126 is further in communication with a recess 128 in the outer cylindrical wall 104.

The rotatable cap 100 includes at its outer diameter thereof a wire retention feature generally shown as 140 which is integrally molded with the cap and is hinged to the cap at 142. The strain relief member 140 includes surfaces 144 which are generally profiled as the raised protuberances 124. The strain relief member 140 further includes side edges 146 which are adjacent but spaced apart forming a wire receiving slot therebetween, although the side edges 146 are conveniently spaced apart a distance less than the outer diameter of the insulated conductor. The strain relief member further includes a bottom edge 148 and a flattened edge 149. A channel 178 is directly below the flattened edge 149 and is formed by the retracting dies which are inserted through the cap during the molding process to define the flattened surfaces 149. It should be noted that an opening 154 is disposed behind the retention finger 140 and extends into the inner cylindrical opening defined by edges 106 and 110, which allows the retention finger 140 to be resilient with respect to the cap 100 and to be hinged only at the upper edge 142. A U-shaped wire receiving trough 150 is located below the wire retention fingers 140 and is profiled with a radius of curvature which allows the introduction of the insulated conductor therein.

The insulative cap 100 further includes a first detent means 172 which is fixed relative to the insulative central body portion 170 and includes a first edge 174 and second edge 176. It should be noted that two detent members 172 are included on each cap being diametrically opposed from one another as best shown in FIG. 5.

The cap 100 further includes a second detent means 190 (FIG. 3) having side edges 192. The side edges 192 allow the detent members 190 to be deflectable relative to the central body portion 170 as the detent members 190 are only hinged at their upper end. Referring now to FIG. 4, the detent members further include a latch portion which is defined by a lead in surface 194 and a latching surface 196. With further reference to FIG. 3A which is a cross-sectional view through lines 3*a*—3*a* of FIG. 3, the latch member has a first shallow sloping surface 198 and a second steep sloping surface 200.

Referring again to FIG. 4, the insulative cap 100 includes two slots 111 which extend into the upper face 102 and downwardly therein. The slots are formed from the retracting dies which are inserted to mold the latching surfaces 196 of the second detent members 190. Conveniently, however, these slots 111 which are formed act as access slots for testing the continuity of the terminal when the terminal is placed within the cylindrical slot and when the conductors are terminated.

Figure 6:
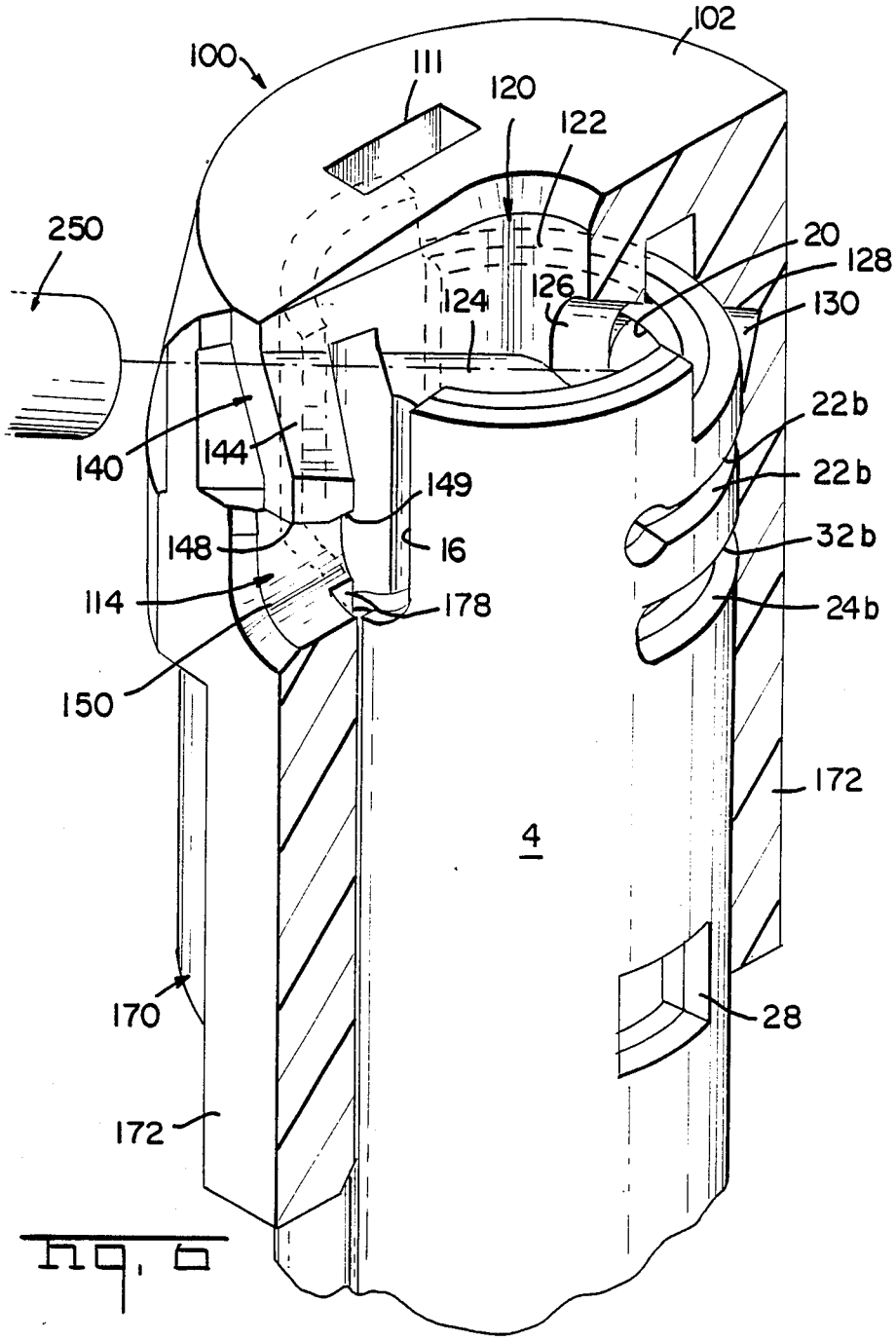
FIG. 6 is an isometric view of a full cutaway of the cap positioned over the terminal and poised for receiving an insulated conductor.
Figure 7:
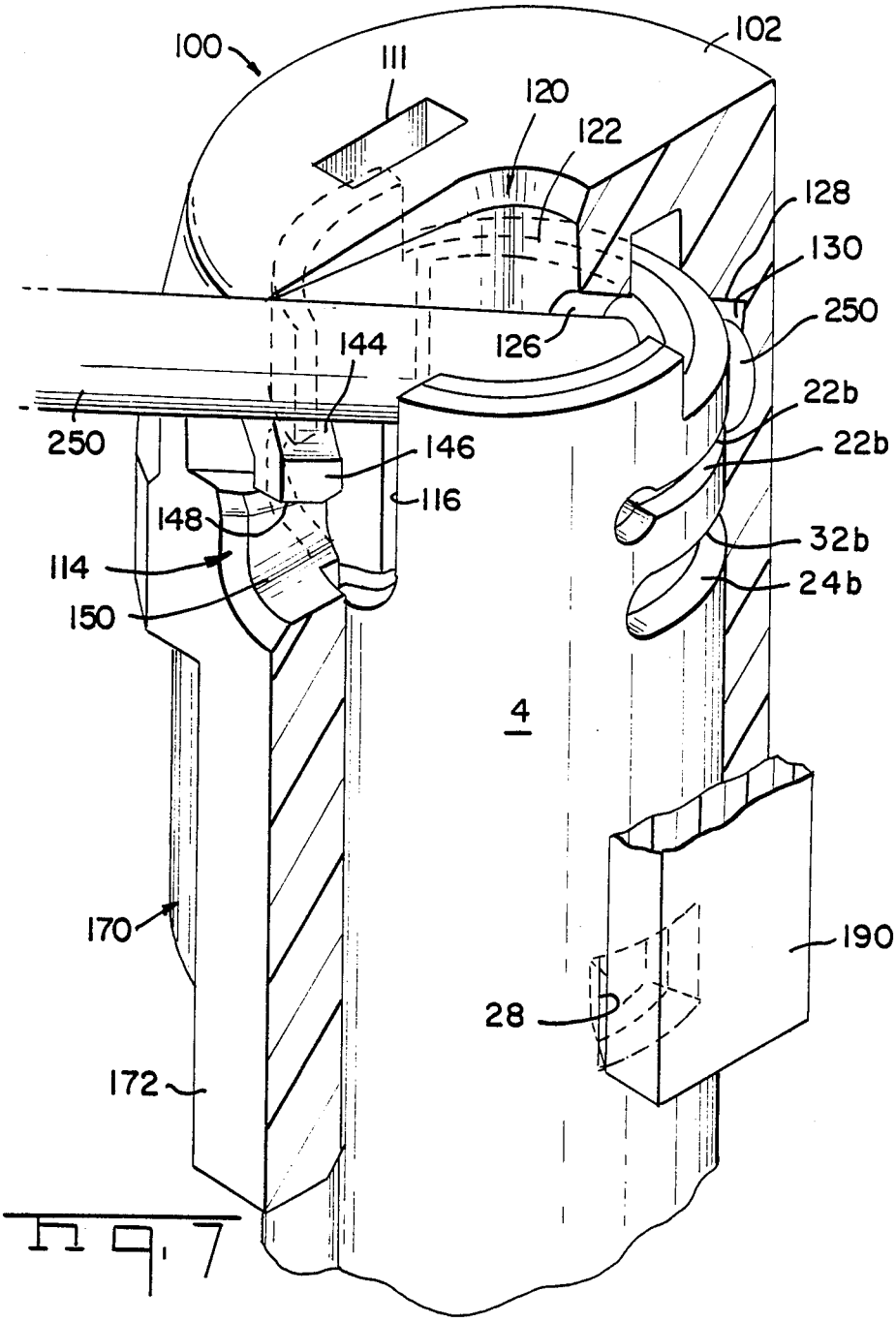
Figure 1:
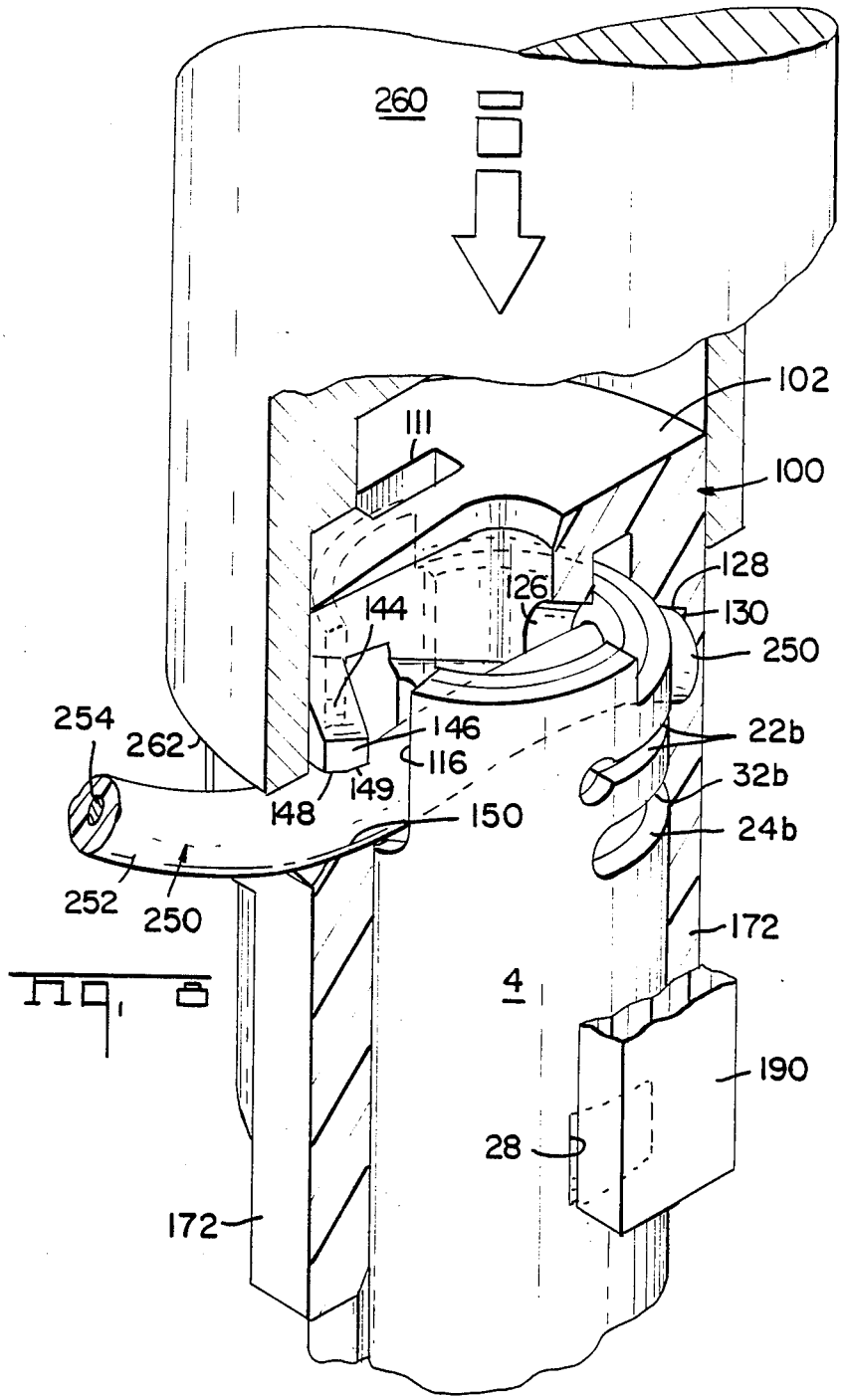

As shown in FIG. 4, the cap is profiled to be slidably received over the terminal 4, the terminal 4 fitting within the cylindrical slot within the cap 100 which is defined between the surfaces 106 and 110 within the cap. It should also be noticed that the cap 100 is inserted over the terminal such that the wire receiving opening 114 aligns with the horizontal portion 16 of the L-shaped slot 14, as shown in FIG. 6. When the cap and terminal are so cooperatively aligned, the detent member 190, which can be seen in FIG. 4, is aligned with the detent cutout 28 within the terminal.

Figure 7:
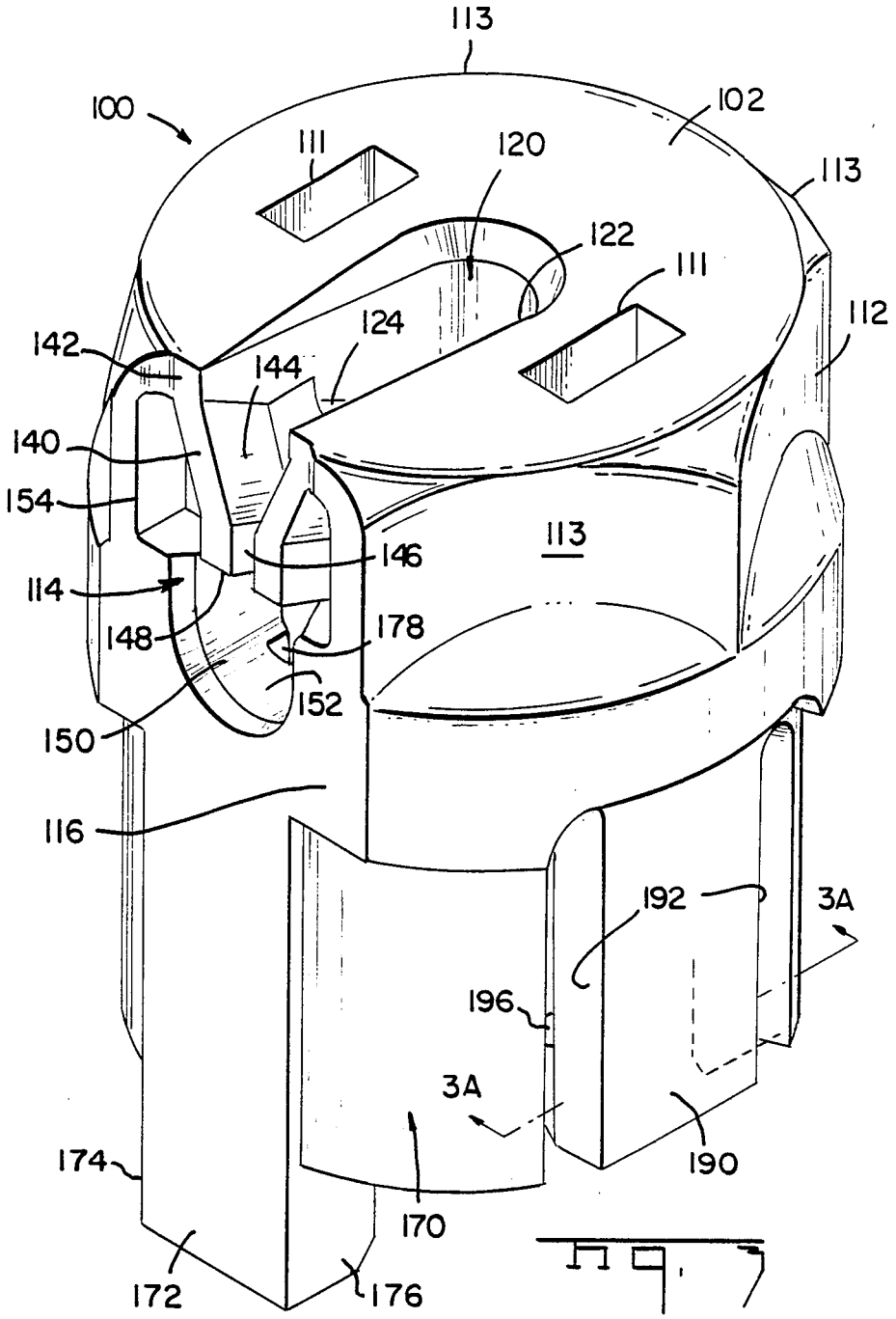

When the cap is placed over the terminal, as shown in FIG. 7, the detent latch 190 shown is axially and radially aligned so as to be disposed within the detent cutout 28. The detent 190, which is diametrically opposed, is not located within a detent cutout but rather is located on the exterior of the terminal portion, but will be moved into a slot 28 when the cap is rotated. Referring again to FIG. 3A, sloping surface 198 is the leading edge which allows the cap to rotate against the detent cutouts whereas the steep sloping surface 200 is the surface which prevents the cap from reversely rotating.

As shown in FIG. 6, it should be noted that when the cap is placed over the terminal such that the wire receiving opening 114 aligns with the vertical slot portion 16 of the L-shaped slot 14, the opening 126, the wire receiving opening 20 and the recessed portion 128 are all mutually aligned to receive an insulated conductor therethrough. It should also be understood that the surface 144 of the retention finger 140 and the surface 124 of the raised protuberance are cooperatively profiled as a guide surface which directs the insulated conductor through the cap and into the opening 126 through the opening 20 of the terminal and into the recessed portion 128, as shown in FIG. 7. It should be appreciated from FIG. 7 that the window 120 allows for the insertion of the wire into the cap when the worker is only able to view the end face 102 of the cap, as the window allows the worker to know exactly where the wire receiving opening 114 is radially located and allows the worker to view the insertion of the wire into the cap and through the terminal from the end of the cap.

Figure 9:
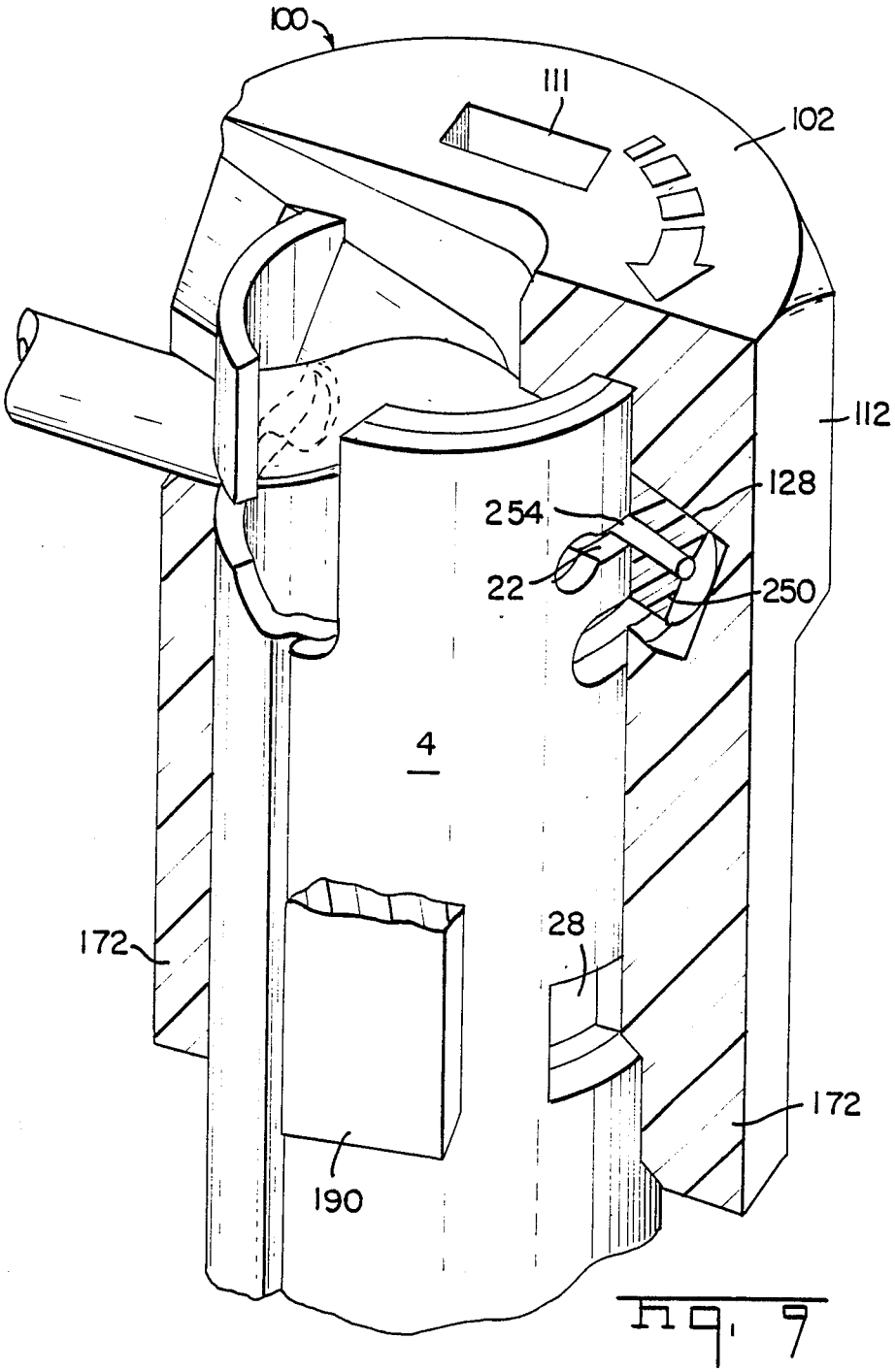
FIG. 9 is an isometric cutaway view showing the completed termination.

As shown in FIG. 8, as the nut driver 260 is placed over the horizontal flats 112 of the cap 100, the lower edge 262 of the nut driver pushes the insulated conductor 250 against surface 144 of the retention fingers 140 and past the retention fingers 140 until the insulated conductor 250 resides in the trough 150, the retaining fingers 140 resiliently springing back to a position such that the lower surfaces 148 and 149 are above the outside diameter of the insulated conductor 250. This also places the wire in a position partially between the raised protuberances 124 and into the relief area which is formed by the intersection of the raised protuberance and the semicircular opening 160. With the insulated conductor within the semicircular trough 150, the nut driver 260 can be rotated in the clockwise direction as viewed from above which moves the insulated conductor from the vertical portion 16 of the L-shaped slot 14 into the horizontal section 18 of the L-shaped slot 14, the horizontal portion 18 being profiled to deform the outer diameter of the insulation 252, thereby providing a strain relief on the wire but not skiving the insulation to the extent that it contacts the conductor 254. As shown in FIG. 8 and 9, rotation of the cap 100 causes the surfaces 126 and 128 to bear on the end of the insulated conductor 250 which extends through the terminal, thereby moving the end of the conductor 250 from a position extending through the wire admitting opening 20 and radially into the wire receiving slot 22 severing the insulation and contacting the conductor 254 of the insulated conductor 250, as shown in FIG. 9.

It should also be noted from FIGS. 1 and 3 that prior to rotation of the cap that surface 176 of the detent member 172 is adjacent to the surface 226 on the housing pedestal 232 and rotation of the cap causes the detent member 172 to override the detent cam 225 such that surface 174 of the detent member 172 is adjacent to the surface 228 of the pedestal 232. The detents 172 in combination with the detents 190 prevent inadvertent rotation of the cap leading to an unseating of the termination between the wire and the termination slot.

Also as shown in FIG. 3, the flats 112 which are adjacent and parallel include inwardly scalloped sections 113 to provide clearance between the flats 112 for admittance of a torquing tool allowing a higher density array of adjacent posts.

The above described embodiment was described with reference to a preferred embodiment but should not be taken to limit the scope of the invention; the attached claims being appended to serve that end.

What is claimed:

1. An electrical connector of the type including a cylindrical terminal having a wire receiving opening in communication with a wire receiving slot, and a rotatable cap disposed over the terminal having a front face and an upper face, and an opening means aligned with the opening in the terminal, the opening means in the cap being profiled to admit an insulated conductor therein and through the opening in the terminal, the rotation of the cap causing a termination of the conductor in the wire receiving slot of the terminal, the connector being characterized in that, the terminal includes an L-shaped slot including a vertical slot which extends downwardly from an upper edge of the terminal, the vertical slot being in transition with a horizontal slot which extends radially partially around the terminal, the opening in the terminal being diametrically opposed from the vertical slot portion and the wire receiving slot being diametrically opposed from the horizontal slot portion, and in that the cap opening means includes a diagonal opening which extends partially within the front face and within the upper face of the cap, the cap including guide means to guide an end of an insulated wire through the wire receiving opening in the terminal and dispose an intermediate portion of the wire above the vertical slot portion.

2. The connector of claim 1 wherein the diagonal opening includes a U-shaped window extending through the upper face of the cap.

3. The connector of claim 2 wherein the opening guide means includes two raised protuberances which slope downwardly towards each other and slope diagonally inward towards the center of the cap.

4. The connector of claim 3 wherein the window provides access to the raised protuberances.

5. The connector of claim 1 wherein the cap includes an inner cylindrical portion and an outer cylindrical portion providing a cylindrical spacing therebetween, the cylindrical spacing being profiled for slidable receipt over the terminal.

6. The connector of claim 5 wherein the cap includes an aperture through the inner cylindrical portion in alignment and in communication with the guide means.

7. The connector of claim 6 wherein the cap further includes a recess in the inner cylindrical portion in alignment with the aperture.

8. An electrical connector for terminating the conductor of an insulated wire, the connector comprising:

a cylindrical terminal means formed of conductive material, the terminal having an opening means at a front side thereof, and a wire admitting opening diametrically opposed from the opening means, the wire admitting opening being in transition with a wire receiving slot, and cap means having an opening in a front face thereof, with strain relief means disposed above the opening in the cap, the strain relief means comprising resilient fingers integrated with the cap extending into the opening, whereby when an insulated wire is introduced into the cap opening the wire extends through the opening means in the terminal and into the wire admitting opening of the terminal, and termination of the wire causes the wire to be held in place by the strain relief means and the wire to be terminated within the wire receiving slot in the terminal.

9. The connector of claim 8 wherein the opening means in the terminal comprises an L-shaped slot having a vertical portion which extends downwardly from an upper edge of the terminal, the vertical portion being in transition with a horizontal portion which radially projects partially around the terminal.

10. The connector of claim 8 wherein the opening in the front face of the cap is U-shaped opening upwardly.

11. The connector of claim 10 wherein ends of the fingers are spaced from a floor of the U-shaped opening.

12. The connector of claim 11 wherein the fingers are diagonally extending inwardly and downwardly towards the center of the U-shaped opening.

13. The connector of claim 12 wherein the fingers are spaced apart a distance less than a diameter of a wire to be terminated.

14. An electrical terminal for receiving and terminating an insulated wire, the terminal comprising an L-shaped slot having a vertical portion extending downwardly from an upper edge thereof, the vertical portion being in transition with a horizontal portion which extends radially around the terminal at least partially, the terminal further comprising a wire admitting opening diametrically opposed from the vertical portion and a wire receiving slot diametrically opposed from the horizontal portion, whereby the insulated wire may be inserted diagonally from an end of the terminal into the wire receiving opening, and an axial force upon the wire disposes the wire into the vertical portion and a succeeding rotational force upon the wire moves the wire into the horizontal portion and terminates an end of the wire in the wire receiving slot.

15. The terminal of claim 14 wherein the horizontal portion is profiled so as to deform the outer diameter of the insulation of the insulated wire.

16. The terminal of claim 14 wherein the portion of the terminal above the horizontal portion prevents the removal of the insulated wire when the wire is in the terminated position.

* * * * *